US011549345B2

(12) United States Patent
Lakhamraju et al.

(10) Patent No.: US 11,549,345 B2
(45) Date of Patent: Jan. 10, 2023

(54) CONTROL OF FLUID PRODUCTION USING RESONANT SENSORS

(71) Applicants: Raghava Raju Lakhamraju, Dhahran (SA); Ameen Malkawi, Dhahran (SA); Ahmed AlAdawy, Dhahran (SA); Naeem-Ur Minhas, Dhahran (SA); Shiv Shankar Sangaru, Dhahran (SA)

(72) Inventors: Raghava Raju Lakhamraju, Dhahran (SA); Ameen Malkawi, Dhahran (SA); Ahmed AlAdawy, Dhahran (SA); Naeem-Ur Minhas, Dhahran (SA); Shiv Shankar Sangaru, Dhahran (SA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 315 days.

(21) Appl. No.: 16/731,796

(22) Filed: Dec. 31, 2019

(65) Prior Publication Data

US 2021/0198986 A1 Jul. 1, 2021

(51) Int. Cl.
*E21B 43/12* (2006.01)
*E21B 49/08* (2006.01)

(52) U.S. Cl.
CPC ..... *E21B 43/121* (2013.01); *E21B 49/087* (2013.01); *E21B 49/0875* (2020.05)

(58) Field of Classification Search
CPC .. E21B 43/121; E21B 49/0875; E21B 49/087; E21B 43/12
See application file for complete search history.

(56) References Cited

U.S. PATENT DOCUMENTS

2016/0102547 A1* 4/2016 Ochoa ..... G01N 9/002 73/152.58
2017/0038491 A1* 2/2017 Gonzalez ..... G01V 1/50
2017/0306751 A1* 10/2017 Harrison ..... E21B 49/082
2019/0145248 A1* 5/2019 Ufondu ..... E21B 43/12 166/250.01
2019/0323338 A1* 10/2019 Seren ..... E21B 23/10

* cited by examiner

*Primary Examiner* — Toan M Le
(74) *Attorney, Agent, or Firm* — Cantor Colburn LLP

(57) ABSTRACT

A system for controlling a flow of fluid includes a flow control device having a fluid channel configured to transport a fluid between a subterranean region and a borehole conduit, a resonant sensing assembly including a resonator body disposed in fluid communication with the fluid channel, and a controller configured to cause the resonator body to vibrate according to an expected resonance frequency of the resonator body. The system also includes a processing device configured to acquire a measurement signal generated by the resonator body, estimate a property of the fluid based on the measurement signal, and control a flow of the fluid through the flow control device based on the property of the fluid.

18 Claims, 4 Drawing Sheets

CONTROL OF FLUID PRODUCTION USING RESONANT SENSORS

BACKGROUND

Exploration and production of energy, in some instances, requires a number of diverse activities from various engineering fields to be performed in a borehole penetrating a subterranean region. In fields related to hydrocarbon production, fluid produced from a subterranean region (e.g., an earth formation or strata) includes a mixture of a number of different fluid types, such as water, oil and gas. As such, some hydrocarbon production systems include systems or components for estimating the proportion of unwanted fluids (e.g., water and non-hydrocarbon gases) in production fluid, and/or for controlling the rate of production based thereon.

SUMMARY

An embodiment of a system for controlling a flow of fluid includes a flow control device having a fluid channel configured to transport a fluid between a subterranean region and a borehole conduit, a resonant sensing assembly including a resonator body disposed in fluid communication with the fluid channel, and a controller configured to cause the resonator body to vibrate according to an expected resonance frequency of the resonator body. The system also includes a processing device configured to acquire a measurement signal generated by the resonator body, estimate a property of the fluid based on the measurement signal, and control a flow of the fluid through the flow control device based on the property of the fluid.

A method of controlling a flow of fluid includes receiving fluid into a fluid channel of a flow control device, the fluid channel configured to transport the fluid between a subterranean region and a borehole conduit, and measuring a property of the fluid by a resonant sensing assembly including a resonator body disposed in fluid communication with the fluid channel. The measuring includes causing the resonator body to vibrate according to an expected resonance frequency of the resonator body, acquiring a measurement signal generated by the resonator body, and estimating the property of the fluid based on the measurement signal; and controlling a flow of the fluid through the flow control device based on the property of the fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Systems, devices and methods are provided herein for controlling the flow of fluid during a subterranean operation. An embodiment of a flow control system includes a flow control device (e.g., an inflow control device (ICD) and/or inflow control valve (ICV)) that is controllable to regulate a flow rate of a fluid, such as production fluid entering a borehole. The system also includes a resonant sensing device having at least one resonator body that is disposed in fluid communication with fluid flowing through the flow control device. The resonator body, in one embodiment, includes an electrically conductive body that is immersed in the fluid or otherwise configured to resonate with a frequency that is affected by fluid flow.

In one embodiment, the resonator body is driven by an oscillating excitation signal according to one or more selected oscillation frequencies, which include a resonance frequency of the resonator body. Responses of the resonator body to the excitation signal are detected and analyzed to estimate one or more properties of fluid flowing through the flow control device. In one embodiment, the resonant sensing device is configured to estimate fluid properties such as density and/or flow rate based on responses of the resonator body. For example, fluid density can be estimated based on changes in a detected resonance frequency of the resonator body, and fluid viscosity can be estimated based on quality factors.

Embodiments described herein provide a number of advantages and technical effects. For example, flow control systems having resonant sensing devices as described herein provide for an effective and relatively simple mechanism for detecting changes in fluid properties. This mechanism can be used to, for example, monitor production fluid from a subterranean region to regulate the flow of production fluid, e.g., if a proportion of water in production fluid is undesirably high. As such, the flow control systems can be used to regulate production to increase efficiency and prevent water breakthrough. In addition, the flow control systems provide increased sensitivity to changes in fluid density and viscosity as compared to conventional systems, which allows for more effective monitoring of production fluids in which the differences in density and viscosity between hydrocarbon fluids (e.g., light oil) and water are relatively small.

Figure 1:
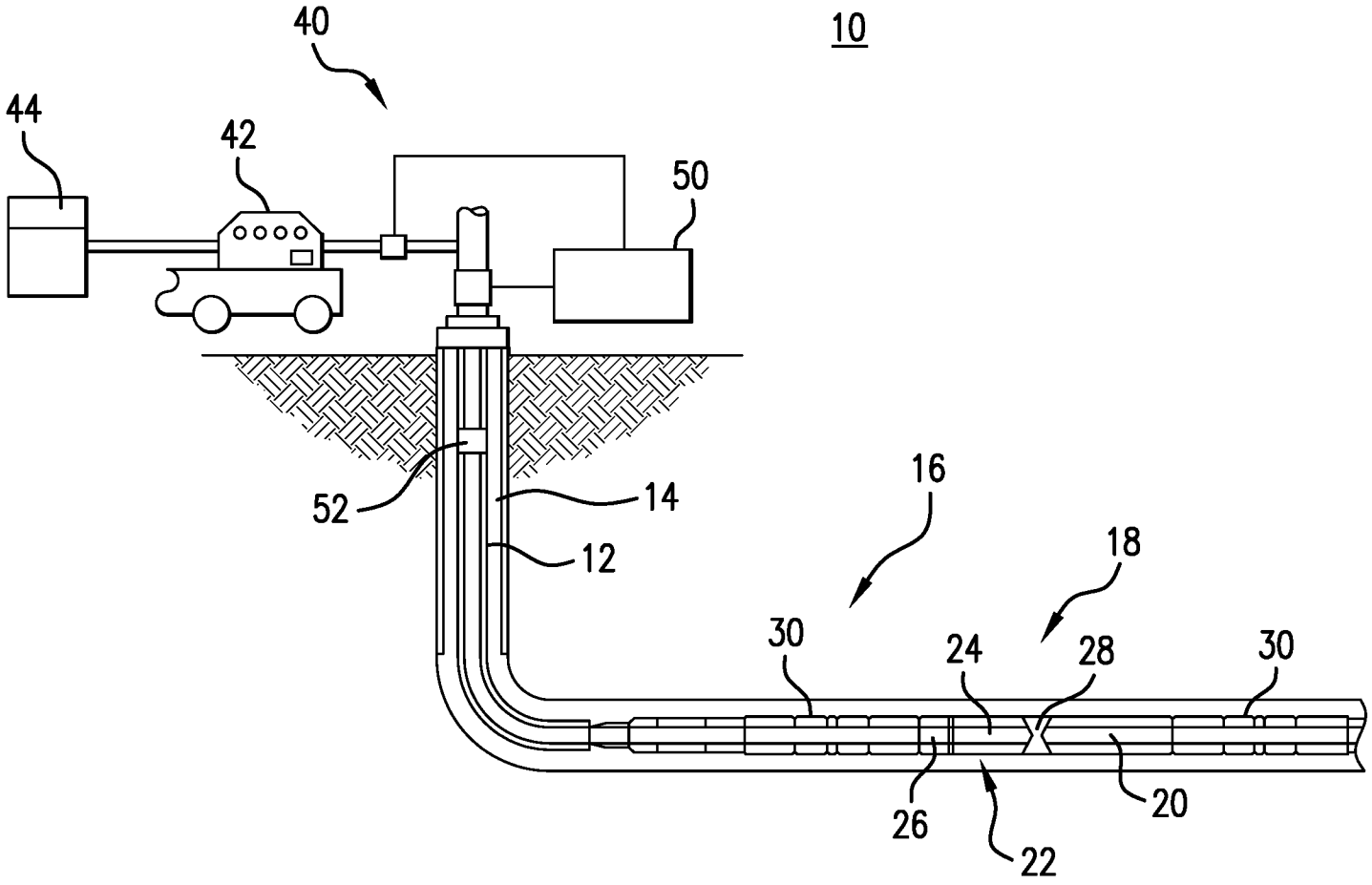
FIG. 1 illustrates an embodiment of an energy production and/or exploration system including a flow control system having a flow control device and a resonant sensing device.

Referring to FIG. 1, an embodiment of a resource or energy production system 10 includes a borehole string 12 disposed in a borehole 14 extending into a subterranean region or a resource bearing formation, such as an earth formation 16. The borehole string 12 is configured as, for example, a production string that establishes a production conduit through which production fluid is brought to the surface. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

The formation 16 may be a hydrocarbon bearing formation or strata that includes, e.g., oil and/or natural gas. In one embodiment, the system 10 is configured for production of hydrocarbons, but is not so limited. The system 10 may be configured for various purposes, such as well drilling operations, completions, resource extraction and recovery, steam assisted gravity drainage (SAGD), $CO_2$ sequestration, geothermal energy production and other operations for which fluid flow control is desired.

For example, the borehole string 12 includes a completion string having a production assembly 18. The production assembly 18, in one embodiment, includes a screen assembly 20 such as a sand screen assembly or sub, and a production fluid flow control assembly 22. In one embodiment, the flow control assembly 22 includes a production fluid control device 24 configured to receive production fluid from a region around the borehole, and a resonant sensing device 26 that includes a resonant sensor in fluid communication with fluid flowing through the flow control assembly 22. An example of a flow control device is an inflow control device (ICD). The resonant sensing device 26 is configured to measure one or more fluid properties, such as density and/or viscosity, and communicate with a valve component 28 or a valve component controller. An example of a valve component is an inflow control valve (ICV) such as an autonomous inflow control valve (AICV).

In one embodiment, the production assembly 18 is configured to control fluid flow by shutting off or restricting fluid flow through the flow control assembly 22 based on a viscosity and/or density of the fluid meeting or exceeding a selected threshold. For example, a threshold is selected based on a desired proportion of water in the production fluid, so that fluid having an unacceptably high proportion of water can be restricted to maintain production efficiency and prevent water breakthrough.

The borehole string 12 and/or the production assembly 18 may also include one or more packer assemblies 30. Each packer assembly 30 includes one or more packer elements, which are actuated to isolate components and/or zones in the borehole 12. For example, multiple packer assemblies 30 can be used to establish production zones around the borehole 14. The borehole string 12 and/or the production assembly 18 may include other components to facilitate production, such as an electric submersible pump (ESP), other artificial lift devices, a fracture or "frac" sleeve device and/or a perforation assembly.

The system 10 also includes surface equipment 40 such as a drill rig, rotary table, top drive, blowout preventer and/or others to facilitate deploying the borehole string 12, operating various downhole components, monitoring downhole conditions and controlling fluid circulation through the borehole 14 and the borehole string 12. In one embodiment, the surface equipment 40 includes a fluid control system 42 including one or more pumps in fluid communication with a fluid tank 44 or other fluid source. The fluid control system 42 facilitates injection of fluids, such as drilling fluid (e.g., drilling mud), stimulation fluid (e.g., a hydraulic fracturing fluid), gravel slurries, proppant and others.

One or more components of the borehole string 12 may be configured to communicate with a surface location (e.g., the surface equipment 40). The communication may be wired or wireless. Examples of wireless communications include mud pulse telemetry, electromagnetic communications and others. Wired communication may be performed via one or more conductors (e.g., electrical wires, hydraulic control lines and/or fiber optics) extending along the borehole string in a cable or other conductor passage.

In one embodiment, the system 10 includes a processing device such as a surface processing unit 50, and/or a subsurface processing unit 52 disposed in the borehole 14 and connected to one or more downhole components. The processing device may be configured to perform functions such as controlling downhole components, transmitting and receiving data, processing measurement data and/or monitoring operations. The processing device may also control aspects of fluid circulation, such as fluid pressure and/or flow rate in the borehole string 12.

The processing device may be disposed at any suitable location. In one embodiment, the processing device is disposed at or in communication with the resonant sensing device 26 and/or the flow control device 24. The processing device, in this embodiment, performs functions that include receiving measurement signals from the resonant sensing device 26, processing or analyzing the signals to estimate a fluid property, and controlling the flow control device 24 and/or the valve component 28 based on the fluid property, as discussed herein.

Figure 2:
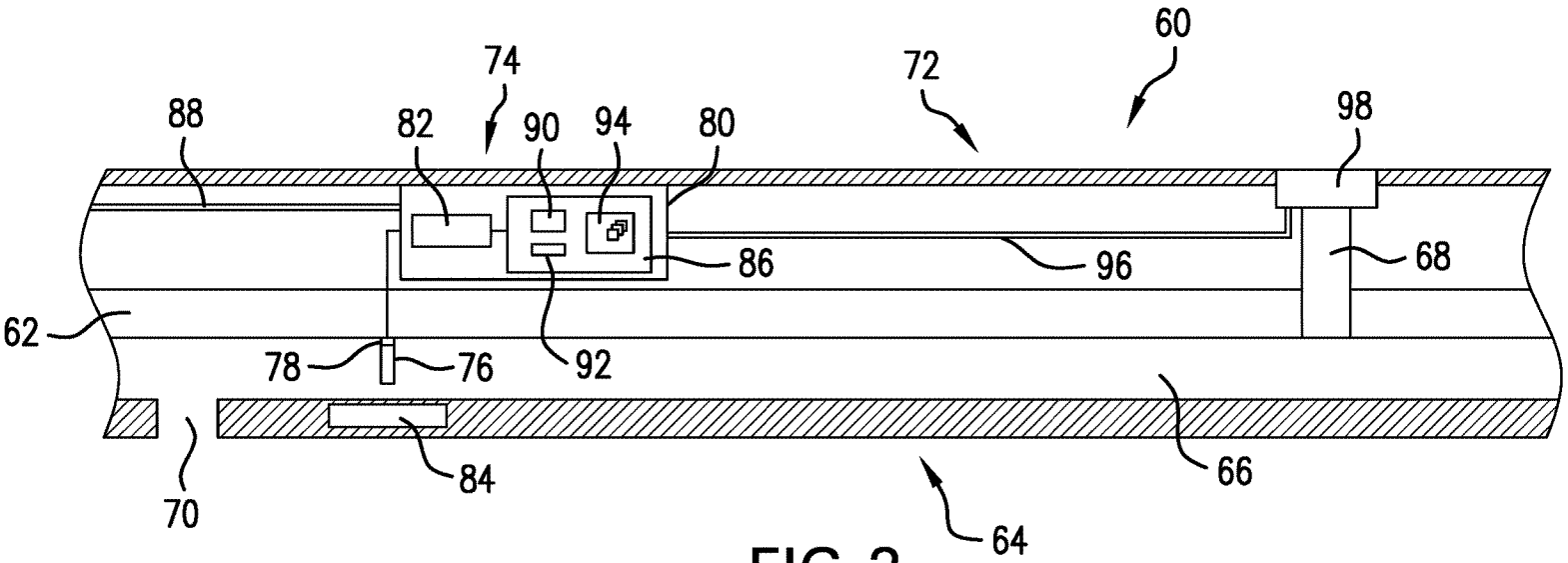
FIG. 2 depicts an embodiment of a flow control device in combination with a resonant sensing assembly, which includes a conductive member configured to be disposed in a fluid channel.

FIG. 2 depicts an embodiment of a flow control device 60, which may be configured as an inflow control device (ICD) or other suitable downhole device. The flow control device 60 includes a tubular device body 62 that defines a central fluid conduit 64. The central fluid conduit 64 is in fluid communication with the surface via a production conduit, such as a production conduit in the borehole string 12.

The body 62 includes or supports a fluid channel 66, which establishes a flow path from an inlet 68 to an outlet 70. In one embodiment, the inlet 68 is in fluid communication with fluid in an annulus 72 of a borehole, and the outlet 70 is in fluid communication with the central fluid conduit 64.

The flow control device 60, in one embodiment, is configured as an inflow control device (ICD) as part of a production system. For example, the flow control device 60 is part of the production assembly 18 of the system 10 (e.g., as the flow control device 24). The flow control device 60 is not so limited, and can be utilized in conjunction with any energy industry system or other system for which fluid flow control is desired.

The fluid channel 66 can extend in any suitable direction and define any suitable fluid flow path. For example, the fluid channel 66 (or multiple fluid channels 66) can follow a linear path along a longitudinal axis of a borehole string and/or the flow control device 60, or a nonlinear path, such as a curved, circumferential, circular, ring-shaped or spiral path.

The flow control device 60 includes a sensing assembly 74 that is configured as a resonant sensor and includes a mechanical resonator. In use, a control circuit or other component of the sensing assembly 74 drives the mechanical resonator at a selected frequency or range of frequencies, and detects changes in the frequency and other characteristics of resonator motion due to fluid flowing in the fluid channel 66. In one embodiment, the mechanical resonator includes one or more electrically conductive members 76 (or simply conductors 76) that are at least partially immersed within fluid flowing through the fluid channel 66, or otherwise disposed relative to the fluid so that properties such as density and viscosity produce a measurable effect on the one or more conductive members 76.

FIG. 2 depicts an example in which the conductive member 76 is disposed within the fluid channel 66 and is immersed within the fluid during operation of the flow control device 60. The conductive member 76 in this example is a rigid member. As described herein, a "rigid"

member is a member that generally retains its shape but can be deformed by fluid so that an oscillating movement can be realized.

In this example, the conductive member 76 is fixedly attached to a surface of the fluid channel 66 via an attachment portion 78. The conductive member 76 can thus act as a cantilever, in that the conductive member 76 is deformable and bends in an oscillating manner in response to, for example, an oscillating electric current or other excitation signal.

To estimate fluid properties, such as density and viscosity, the conductive member 76 is driven by an excitation signal. In this example, the excitation signal is generated by a sensing and/or control module 80. The sensing and/or control module 80 includes or controls excitation circuitry 82 to generate excitation signals configured to cause the conductive member 76 to vibrate at a fundamental resonance frequency of the conductive member 76. For example, the excitation signals include oscillating signals having frequencies that are at an expected fundamental resonance frequency.

The expected fundamental resonance frequency can be calculated based on geometric and material properties of the conductive member 76 and expected downhole conditions (e.g., temperature, pressure, expected fluid constituents). For example, expected resonance frequencies may be selected based on a resonator model and expected fluid properties and conditions (e.g., densities associated with various production fluid constituent component proportions, pressures, temperatures and flow rates). The frequency response to excitation signals (which may be at the expected resonance frequency or swept within a frequency range that includes the expected resonance frequency) can be analyzed to measure actual vibration frequencies of the conductive member 76 and other characteristics of movement of the conductive member 76.

In one embodiment, as shown in FIG. 2, the conductive member 76 includes or is made of a piezoelectric material (e.g., quartz), and the excitation circuitry 82 (including, e.g., a Wheatstone bridge circuit) is configured to apply an oscillating electrical current to the conductive member 76. The oscillating current is applied at one or more frequencies, one of which is a frequency corresponding to the expected resonance frequency.

In this embodiment, the sensing assembly 74 includes a magnetic device 84 (e.g., a permanent magnet or electromagnet) that is located proximate to the conductive member 76, i.e., is located relative to the conductive member 76 so that the conductive member 76 is within a magnetic field generated by the magnetic device 84. Interaction between the oscillating excitation current and the magnetic field generates Lorentz forces. The Lorentz forces change the movement and/or displacement of the conductive member 76, and are exploited to measure the effect that fluid properties have on the conductive member 76.

A processing device, such as a controller 86, receives measurement signals in the form of voltage signals produced by the vibrating conductive member 76, and analyzes the measurement signals to estimate fluid properties. In one embodiment, a controller 86 is disposed at the flow control device 60. The controller 86 may be a processing device or module that is embedded within the body 62, disposed in a chamber in the body 62 or otherwise fixedly disposed relative to the conductive member 76. Although the processing device is disposed downhole in this embodiment, it is not so limited. For example, measurement signals can be transmitted to a processing device located in another borehole string component or at the surface, via a communication line 88.

To estimate fluid density, an excitation current is applied to the conductive member 76 at a plurality of frequencies that include the expected resonance frequency. For example, the controller 86 controls the excitation circuitry 82 to apply an oscillating current and sweep the oscillating current over a frequency range that includes the expected resonance frequency. Frequencies of the resulting measurement signals are analyzed to calculate a resonance frequency of the conductive member 76 as immersed in production fluid, and estimate changes in the resonance frequency. Such changes can then be used to estimate fluid density. Generally, lower resonance frequencies correspond to higher fluid densities.

To estimate fluid viscosity, the measurement signals are analyzed to calculate damping effects of the fluid, which limits the maximum amplitude of the oscillations of the conductive member 76. A damping effect is determined using a quality factor Q, which is defined as the ratio of the total energy stored in an oscillating structure ($E_M$) to the energy factor lost per cycle ($E_C$) due to the damping effect. The fluid viscosity can be estimated based on the quality factor, where higher viscosities are associated with higher damping effects.

The controller 86 includes components for performing various functions, including control of the excitation signals, detection of measurement signals, calculation of fluid properties and/or control of the flow control device 60 based on measured fluid properties. The controller 86, in one embodiment, includes a processor 90, an input/output device 92 and a data storage device (or a computer-readable medium) 94 for storing data, files, models, data analysis modules and/or computer programs.

In one embodiment, the controller 86 (or other suitable processing device or system) is configured to control the flow of fluid through the flow control device 60. For example, the controller 86 is connected via a control line 96 to a valve 98. The controller 86 can restrict fluid flow in response to measured fluid properties (e.g., density or viscosity above a threshold) by sending a control signal to cause the valve to restrict the valve opening or close completely.

Figure 3:
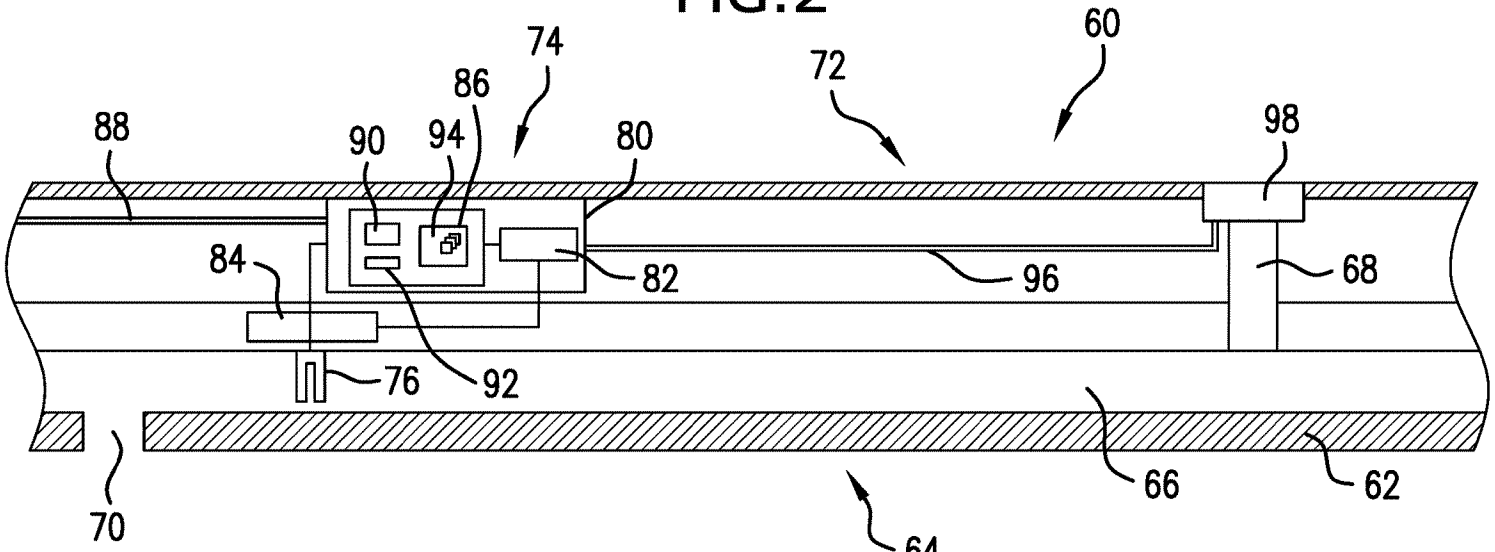
FIG. 3 depicts an embodiment of a flow control device in combination with a resonant sensing assembly, which includes a conductive member configured as a tuning fork and disposed in a fluid channel.

FIG. 3 depicts an example of the sensing assembly 74, in which the conductive member 76 is configured as a tuning fork resonator that protrudes into the fluid channel 66 and is partially or fully immersed in fluid flowing through the fluid channel 66.

In this example, the tuning fork is driven by an electromagnet 84 disposed proximate to the tuning fork, so that the tuning fork is within a magnetic field generated by the electromagnet 84. The electromagnet 84 is controlled, e.g., by the controller 86, by applying an excitation current to the electromagnet 84 to cause the electromagnet to generate an oscillating magnetic field, which in turn causes the tuning fork to vibrate.

The tuning fork may be electrically connected to the controller 86 in various ways so that the controller 86 can acquire voltage signals from the tuning fork. For example, the tuning fork is connected to the controller via a physical conductor (wire). In another example, an electromagnetic pickup including a permanent magnet transmits measurement signals.

The frequency response of the immersed tuning fork, which is related to mass density and viscosity, can be analyzed to estimate fluid properties including density and/or viscosity. In one embodiment, the tuning fork is driven by oscillating (e.g., sinusoidal) excitation currents having a range of frequencies, and is thereby swept among a range of frequencies that is selected so that the range of frequencies includes expected resonance frequencies. The frequency response to these excitation currents is analyzed to calculate a measured resonance frequency of the tuning fork and/or quality factors.

Figure 4:
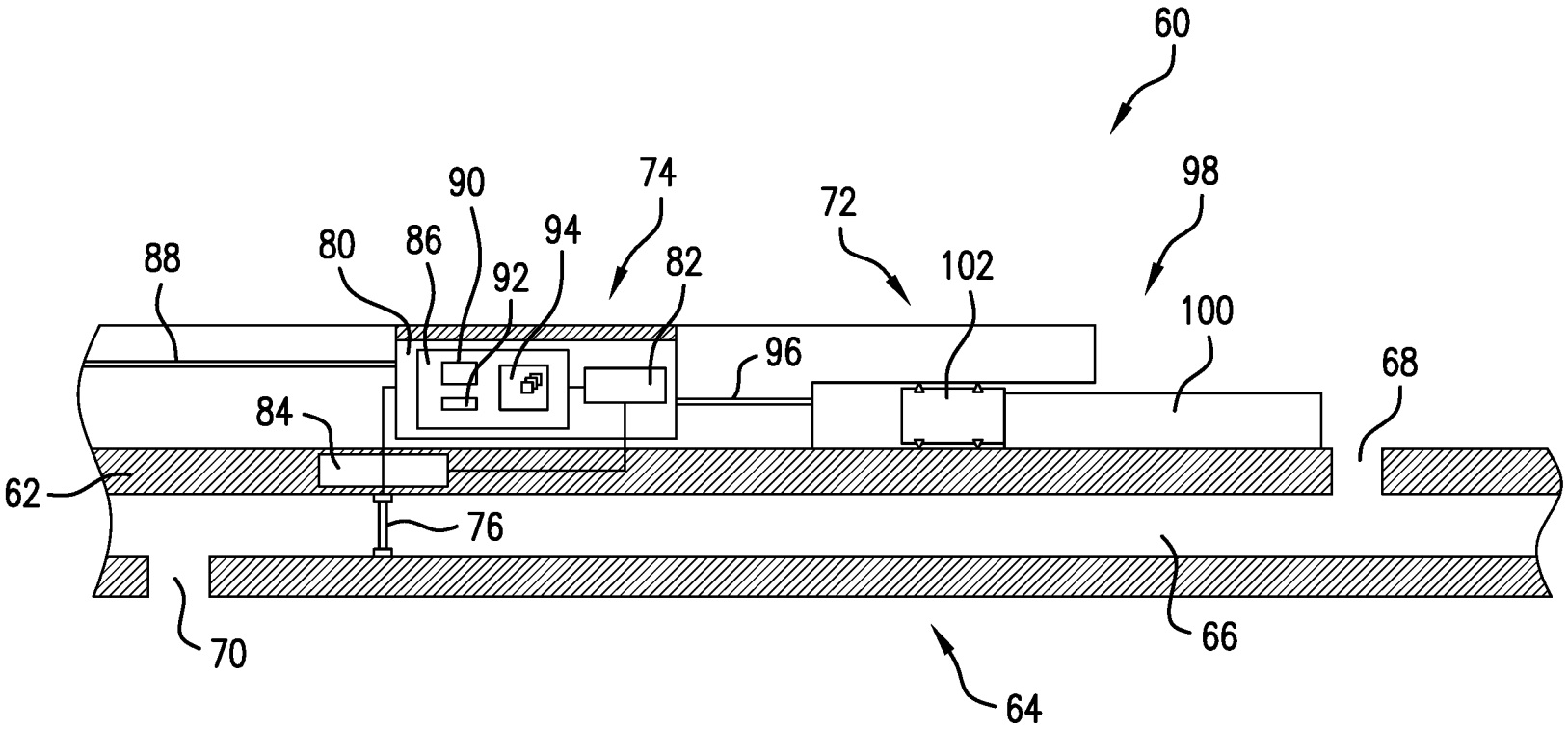
FIG. 4 depicts an embodiment of a flow control device in combination with a resonant sensing assembly, which includes a conductive member attached to opposing surfaces of a fluid channel.

FIG. 4 depicts an embodiment of the sensing assembly 74, in which the conductive member 76 is attached to two opposing surfaces of the fluid channel 66. The conductive member in this embodiment may be a rod, bar, wire, vibrating membrane or any other component that can be used to estimate fluid properties as described herein.

FIG. 4 also illustrates an example of the valve 98. In this example, the valve 98 includes a slidable member 100, such as a sliding sleeve, ring or other structure. The slidable member 100 can be controlled via the controller 86 or other suitable downhole or surface device to operate an actuator 102 to move the slidable member 100 axially to obstruct the inlet 68.

It is noted that the above examples and embodiments are not intended to be limiting. For example, the embodiments and examples are not limited to any particular configuration of the conductive member 76. In addition, the embodiments and examples are not limited to any particular flow control device or valve device.

Figure 5:
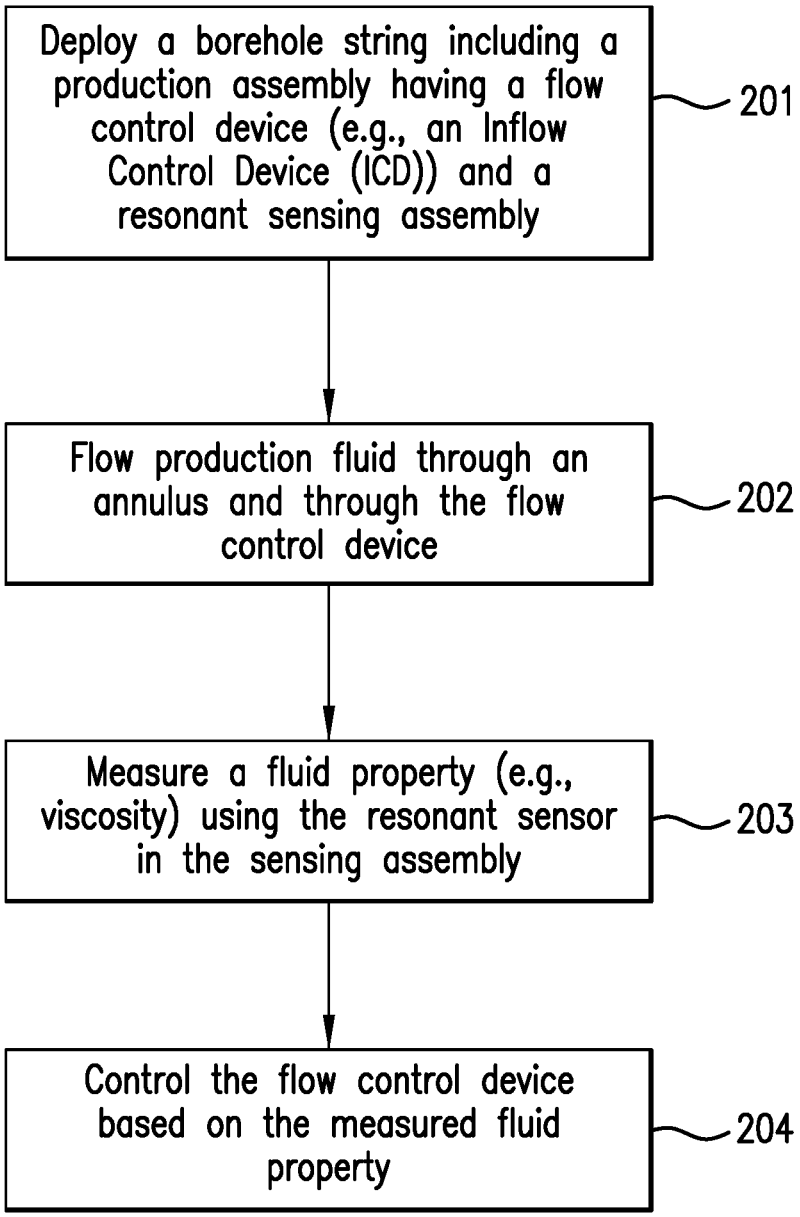
FIG. 5 is a flow chart depicting an embodiment of a method of controlling fluid flow.

FIG. 5 is a flow chart that illustrates an embodiment of a method 200 of controlling fluid flow and/or producing energy from a subterranean region. Aspects of the method 200 or functions or operations performed in conjunction with the method (e.g., controlling fluid injection and/or production fluid flow rates) may be performed by one or more processing devices, such as the surface processing unit 50, subsurface processing unit 52 and/or the controller 86, either alone or in conjunction with a human operator.

The method 200 is discussed in conjunction with the system 10 of FIG. 1, and with the flow control device and sensing assembly of FIG. 2, but is not so limited. The method 200 includes one or more stages 201-204. In one embodiment, the method 200 includes the execution of all of the stages 201-204 in the order described. However, certain stages may be omitted, stages may be added, or the order of the stages changed.

In the first stage 201, an energy industry operation, such as a production operation, is performed. For example, the borehole string 12 is deployed into the borehole 14 and advanced to a selected depth or location along the borehole 14. The borehole string includes a production assembly and a flow control device such as the flow control device 60, which may be an autonomous or actively controlled ICD. Various operations may be performed prior to commencing production, such a completion and/or stimulation operations (e.g., perforation and/or hydraulic fracturing).

In the second stage 202, the flow control device 60 or other suitable component is activated to commence production of fluid (referred to as production fluid) from the formation 16 and the borehole 14. Production fluid is advanced from the formation 16, into an annulus of the borehole 14, and flows into the flow control device 60. The production fluid may include various proportions of hydrocarbons and undesired fluids such as water. For example, the production fluid includes a mixture of light oil and water.

In the third stage 203, fluid properties are measured using a resonant sensor such as the sensing assembly 74. For example, fluid density is estimated based on measurements of the resonance frequency of a resonator body (e.g., the conductive member 76) in the production fluid. Fluid viscosity can be estimated based on calculated quality factors, as discussed in more detail above.

In the fourth stage 204, the flow control device 60 is operated based on the measured fluid properties. For example, measurements of density and/or viscosity are used to indicate the proportion of water in the production fluid. The density and/or viscosity are compared to a threshold value or values, which are selected based on a proportion of water in the production fluid.

Increases in density and/or viscosity (or excessive values of density and/or viscosity) may indicate that the proportion of water is unacceptably high. If so, a processing device controls the flow control device 60 to completely choke off or restrict flow through the flow control device 60. This control may be performed to prevent water breakthrough and/or restrict various production zones having excessive amounts of water.

Set forth below are some embodiments of the foregoing disclosure:

Embodiment 1: A system for controlling a flow of fluid, comprising: a flow control device including a fluid channel configured to transport a fluid between a subterranean region and a borehole conduit; a resonant sensing assembly including a resonator body disposed in fluid communication with the fluid channel; a controller configured to cause the resonator body to vibrate according to an expected resonance frequency of the resonator body; and a processing device configured to acquire a measurement signal generated by the resonator body, estimate a property of the fluid based on the measurement signal, and control a flow of the fluid through the flow control device based on the property of the fluid.

Embodiment 2: The system of any prior embodiment, wherein the resonator body is a rigid electrically conductive member disposed within the fluid channel and immersed in the fluid during the flow of the fluid through the flow control device.

Embodiment 3: The system of any prior embodiment, wherein the rigid electrically conductive member is configured as a tuning fork.

Embodiment 4: The system of any prior embodiment, wherein the resonant sensing assembly includes a magnetic device disposed relative to the resonator body so that the resonator body is positioned within a magnetic field generated by the magnetic device Embodiment 5: The system of any prior embodiment, wherein the magnetic device includes an electromagnet driven by the controller to generate an oscillating magnetic field at the resonance frequency that causes the resonator body to vibrate.

Embodiment 6: The system of any prior embodiment, wherein resonator body is a piezoelectric body, and the resonant sensing assembly includes a magnetic device configured to apply a magnetic field to the body, and an excitation circuit configured to apply an excitation current to the piezoelectric body.

Embodiment 7: The system of any prior embodiment, wherein the controller is configured to apply an oscillating excitation signal having a plurality of frequencies in a frequency range including the resonant frequency.

Embodiment 8: The system of any prior embodiment, wherein the fluid property includes a fluid density, and the processing device is configured to estimate the fluid density based on a measured resonance frequency, the measured resonance frequency estimated based on the measurement signal.

Embodiment 9: The system of any prior embodiment, wherein the fluid property includes a fluid viscosity, and the processing device is configured to estimate the fluid viscosity based on a quality factor based on the measurement signal.

Embodiment 10: The system of any prior embodiment, wherein the flow control device is operably connected to a flow control valve, and the processing device is configured to control the flow control valve based on the fluid property.

Embodiment 11: The system of any prior embodiment, wherein the flow control device is at least part of an inflow control device (ICD).

Embodiment 12: A method of controlling a flow of fluid, comprising: receiving fluid into a fluid channel of a flow control device, the fluid channel configured to transport the fluid between a subterranean region and a borehole conduit; measuring a property of the fluid by a resonant sensing assembly including a resonator body disposed in fluid communication with the fluid channel, wherein the measuring includes causing the resonator body to vibrate according to an expected resonance frequency of the resonator body, acquiring a measurement signal generated by the resonator body, and estimating the property of the fluid based on the measurement signal; and controlling a flow of the fluid through the flow control device based on the property of the fluid.

Embodiment 13: The method of any prior embodiment, wherein the resonator body is a rigid electrically conductive member disposed within the fluid channel and immersed in the fluid during the flow of the fluid through the flow control device.

Embodiment 14: The method of any prior embodiment, wherein the rigid electrically conductive member is configured as a tuning fork.

Embodiment 15: The method of any prior embodiment, wherein the resonant sensing assembly includes a magnetic device disposed relative to the resonator body so that the resonator body is positioned within a magnetic field generated by the magnetic device Embodiment 16: The method of any prior embodiment, wherein the resonator body is caused to vibrate at the resonance frequency by an oscillating magnetic field generated by an electromagnet.

Embodiment 17: The method of any prior embodiment, wherein resonator body is a piezoelectric body, the resonant sensing assembly includes a magnetic device configured to apply a magnetic field to the body, and causing the resonant body to vibrate includes applying an excitation current to the resonant body.

Embodiment 18: The method of any prior embodiment, wherein the resonant body is caused to vibrate by applying an oscillating excitation signal to the resonant body, the oscillating excitation signal having a plurality of frequencies in a frequency range including the resonant frequency.

Embodiment 19: The method of any prior embodiment, wherein the fluid property includes a fluid density, and measuring the fluid property includes estimating the fluid density based on a measured resonance frequency, the measured resonance frequency based on the measurement signal.

Embodiment 20: The method of any prior embodiment, wherein measuring the fluid property includes estimating a fluid viscosity by calculating a quality factor based on the measurement signal.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for controlling a flow of fluid, comprising:

a flow control device including a fluid channel configured to transport a fluid between a subterranean region and a borehole conduit;

a resonant sensing assembly including a resonator body disposed in fluid communication with the fluid channel, the resonator body including at least one of: a vibrating membrane, and a rigid electrically conductive member having opposing ends attached to an inner surface of the fluid channel, the resonator body configured to be at least partially immersed in the fluid;

a controller configured to cause the resonator body to vibrate according to an expected resonance frequency of the resonator body; and a processing device configured to acquire a measurement signal generated by the resonator body, estimate a property of the fluid based on the measurement signal, and control a flow of the fluid through the flow control device based on the property of the fluid.

2. The system of claim 1, wherein the resonator body is immersed in the fluid during the flow of the fluid through the flow control device.

3. The system of claim 1, wherein the resonant sensing assembly includes a magnetic device disposed relative to the resonator body so that the resonator body is positioned within a magnetic field generated by the magnetic device.

4. The system of claim 3, wherein the magnetic device includes an electromagnet driven by the controller to generate an oscillating magnetic field at the resonance frequency that causes the resonator body to vibrate.

5. The system of claim 1, wherein resonator body is a piezoelectric body, and the resonant sensing assembly includes a magnetic device configured to apply a magnetic field to the body, and an excitation circuit configured to apply an excitation current to the piezoelectric body.

6. The system of claim 1, wherein the controller is configured to apply an oscillating excitation signal having a plurality of frequencies in a frequency range including the resonant frequency.

7. The system of claim 6, wherein the fluid property includes a fluid density, and the processing device is configured to estimate the fluid density based on a measured resonance frequency, the measured resonance frequency estimated based on the measurement signal.

8. The system of claim 6, wherein the fluid property includes a fluid viscosity, and the processing device is configured to estimate the fluid viscosity based on a quality factor based on the measurement signal.

9. The system of claim 1, wherein the flow control device is operably connected to a flow control valve, and the processing device is configured to control the flow control valve based on the fluid property.

10. The system of claim 1, wherein the flow control device is at least part of an inflow control device (ICD).

11. A method of controlling a flow of fluid, comprising:

receiving fluid into a fluid channel of a flow control device, the fluid channel configured to transport the fluid between a subterranean region and a borehole conduit;

measuring a property of the fluid by a resonant sensing assembly including a resonator body disposed in fluid communication with the fluid channel, the resonator body including at least one of: a vibrating membrane, and a rigid electrically conductive member having opposing ends attached to an inner surface of the fluid channel, the resonator body configured to be at least partially immersed in the fluid, wherein the measuring includes causing the resonator body to vibrate according to an expected resonance frequency of the resonator body, acquiring a measurement signal generated by the resonator body, and estimating the property of the fluid based on the measurement signal; and controlling a flow of the fluid through the flow control device based on the property of the fluid.

12. The method of claim 11, wherein the resonator body is immersed in the fluid during the flow of the fluid through the flow control device.

13. The method of claim 11, wherein the resonant sensing assembly includes a magnetic device disposed relative to the resonator body so that the resonator body is positioned within a magnetic field generated by the magnetic device.

14. The method of claim 13, wherein the resonator body is caused to vibrate at the resonance frequency by an oscillating magnetic field generated by an electromagnet.

15. The method of claim 11, wherein resonator body is a piezoelectric body, the resonant sensing assembly includes a magnetic device configured to apply a magnetic field to the body, and causing the resonant body to vibrate includes applying an excitation current to the resonant body.

16. The method of claim 11, wherein the resonant body is caused to vibrate by applying an oscillating excitation signal to the resonant body, the oscillating excitation signal having a plurality of frequencies in a frequency range including the resonant frequency.

17. The method of claim 16, wherein the fluid property includes a fluid density, and measuring the fluid property includes estimating the fluid density based on a measured resonance frequency, the measured resonance frequency based on the measurement signal.

18. The method of claim 16, wherein measuring the fluid property includes estimating a fluid viscosity by calculating a quality factor based on the measurement signal.

* * * * *